US005125135A

United States Patent [19]

Kalteis

[11] Patent Number: 5,125,135

[45] Date of Patent: Jun. 30, 1992

[54] NEEDLING MACHINE

[75] Inventor: Augustin Kalteis, Leonding, Austria

[73] Assignee: Textilmaschinenfabrik Dr. Ernst Fehrer Aktiengesellschaft, Leonding, Austria

[21] Appl. No.: 665,251

[22] Filed: Mar. 6, 1991

[30] Foreign Application Priority Data

Mar. 20, 1990 [AT] Austria ..... 643/90

[51] Int. Cl.[5] ..... D04H 18/00

[52] U.S. Cl. ..... 28/107

[58] Field of Search ..... 28/107, 111, 114, 115, 28/108, 109, 110, 113

[56] References Cited

U.S. PATENT DOCUMENTS

| | | | |
|---|---|---|---|
| 3,368,256 | 2/1968 | Fehrer et al. | 28/107 |
| 3,391,436 | 7/1968 | Fehrer | 28/107 |
| 3,602,967 | 9/1971 | Zocher et al. | 28/111 |
| 4,384,393 | 5/1983 | Asselin | 28/107 |
| 4,884,324 | 12/1989 | Stanislaw | 28/107 |
| 4,977,653 | 12/1990 | Pum | 28/115 |

*Primary Examiner*—Werner H. Schroeder
*Assistant Examiner*—Amy Brooke Vanatta
*Attorney, Agent, or Firm*—Collard & Roe

[57] ABSTRACT

To ensure that a needle board of a needling machine can be detached from the needle beam in a simple manner and without a substantial expenditure of work, the needle beam is provided with spring-biased mechanisms for clamping the needle board and actuators associated with said clamping mechanisms are provided on the machine frame or on the stripper.

13 Claims, 3 Drawing Sheets

NEEDLING MACHINE

BACKGROUND OF THE INVENTION

1. Field of the Invention

This invention relates to a needling comprising rods, which are slidably mounted in a frame and reciprocable to actuate at least one needle beam, which is provided with holding means for detachably mounting a needle board, and a stripper, which is associated with the needle board and adjustably mounted in the frame.

2. Description of the Prior Art

The needle boards of needling machines for needling nonwoven webs are usually detachably mounted by holding means on the needle beam, which is arranged to move up and down. In that case the needle boards can be removed, e.g., for a replacement of damaged needles or for an alteration of the machine to provide a different needle pitch or to provide different needles. To that end the needle boards are screw-connected to the needle beam. Whereas this permits a reliable connection between the needle beam and the needle board without an increase of the mass which is moved by means of the needle beam, a replacement of the board will require a considerable expenditure of work.

SUMMARY OF THE INVENTION

For this reason it is an object of the invention so to improve with simple structural means a needling machine of the kind described first hereinbefore that the needle board can be replaced quickly and with a small expenditure of work whereas the mass that is to be moved by means of the needle beam need not substantially be increased.

The object set forth is accomplished in accordance with the invention in that the holding means comprise spring-biased clamping mechanisms, which are mounted on the needle beam and clamp the needle board against the needle beam, and actuators, which are mounted on the frame or on the stripper and are associated with the clamping mechanisms and operable to open said clamping mechanisms against their spring bias.

The provision of spring-biased clamping mechanisms for clamping the needle board in position against the needle beam permits a simple and quick replacement of the board because for a release of the needle board it will be sufficient to open the clamping mechanisms against their spring bias. A needle board will automatically be clamped in position by the spring bias of the clamping mechanism and that spring bias can so be selected that the required clamping forces can readily be exerted by the clamping mechanisms. The clamping mechanisms with their biasing springs do not appreciably increase the masses which are to be moved by means of the needle beam, because the actuators for opening the clamping mechanisms are associated with the frame or the stripper rather than with the needle beam so that the mass to be moved by means of the needle beam is increased only by the clamping mechanisms.

The design of the clamping mechanisms can be selected within a very wide field because it is merely required to clamp the needle board against the needle beam under a spring bias. But a particularly desirable design will be obtained if the clamping mechanisms comprise draw hooks, which are springbiased in the pulling direction and on that side of the needle beam which faces away from the needle board are slidably guided in the pulling direction transversely to the plane of the needle board. Because the draw hooks are movably mounted on the needle beam on that side thereof which faces away from the needle board the space which is available is desirably utilized whereas the function of the needle board will not adversely be affected. Besides, the desired clamping forces can be exerted via the draw hooks in a simple manner and by a structure which is relatively light in weight.

If the draw hooks embrace the edge portion of the needle board they will not impose any restriction on the distribution of the needles. In that case the release of the edge portion of the board by the draw hooks as the clamping mechanisms are opened will be assisted if the guides for slidably mounting the draw hooks are inclined toward the needle beam about an axis which is parallel to the edge of the needle board. Upon an opening of the clamping mechanisms that inclination of the guides will cause the draw hooks to perform a movement having a lateral component which is directed away from the edge of the needle board so that the handling of the needle board when the clamping mechanisms have been opened will be facilitated by the freedom of lateral movement which has thus been provided. In that case the draw hooks which embrace the edge portion of the needle board may serve to guide the needle board if the needle board is to be pulled away from the needle beam in a direction which is parallel to the edge of the needle board. To provide clamping mechanisms which are light in weight and compact, the guides for the draw hooks may be constituted by guide pins, which extend through the biasing springs and can be screwed into the needle beam.

To open the clamping mechanisms it is necessary that the actuators move the spring-biased clamping elements in the opening sense against the force of the biasing spring. To that end the actuators may be provided with a drive of their own but it will also be possible to provide the actuators for the clamping mechanisms as coupling stops carried by the adjustable stripper because in that case the drive means for adjusting the stripper can be used to adjust the coupling stops relative to the clamping mechanisms. That design will be particularly recommendable if the clamping mechanisms are provided at the edge of the needle board adjacent to structural parts which are fixed to the stripper. If the guide for the clamping element of the clamping mechanisms is inclined from the direction in which the stripper is adjustable, the opening movement of the clamping mechanism will be accompanied by a relative movement between the clamping element and the coupling stop which is provided on the stripper. To ensure that such a relative movement will not involve sliding friction, each coupling stop may comprise a roller for engaging the associated clamping mechanisms.

Instead of draw hooks provided at the edge of the needle board it is possible to provide draw hooks disposed within the area of the needle board. With such an arrangement of the draw hooks they may engage tie rods, which are fixed to the needle board and extend through the needle beam and have an undercut for engaging the hook and the draw hooks have a ramp surface which is engageable for deflecting the draw hooks away from the undercut of the tie rod during a displacement of the hook in the opening sense. Owing to the spring bias of the draw hooks, which engage the tie rods at the undercuts thereof, the draw hooks pull the needle board firmly against the needle beam so that a rigid connection between the needle beam and the needle board is established. But the needle board can be removed from the needle beam when the draw hooks have released the tie rods in that the draw hooks have been deflected from the undercuts. Because a release of the clamping mechanism will require a displacement of the tie rods against the force of the associated biasing springs, that displacement of the tie rods may also be used to effect a deflecting movement if the undercut is succeeded in the direction of the displacement of the draw hooks by a ramp surface which is fixed to the beam and on which the draw hooks slide so that they are deflected as desired. As a result, the needle board can be pulled from the needle beam at right angles to the plane of the board and this movement will not be restricted by the tie rods. When it is desired to clamp a needle board in position, the draw hooks are released by the actuators and then slide back along the ramp surface to their clamping position, in which they interengage with the undercut of the tie rods.

If the draw hooks are disposed within the needle board area, tie rods for the needle board must extend through the needle beam and the distribution of the needles may be restricted by the tie rods. To minimize such possible restriction it is necessary to restrict the number of tie rods. To ensure that the required clamping forces can be transmitted in spite of such a restriction of the number of tie rods it is possible to provide draw rods which are constituted by tongues, which are formed in a tube between axial slots thereof, and to arrange the tie rods of the needle board so that each of them extends into one of the tubes which constitute the draw hooks so that the cooperation of each tie rod with a plurality of draw hooks will be ensured. The tube tongues which constitute draw hooks have an adequate radial spring action so that the draw hooks can be deflected from the tie rod. In that case the ramp surface which deflects the draw hooks may simply be constituted by an external cone of a sleeve which is provided in the needle beam and serves to guide the tie rod. The guidance of the tie rods in such guide sleeves will also center the needle board so that there will be no need for separate centering means, such as pins, for the needle board whereas such centering means will be required if the clamping mechanisms engage the needle board at its edge.

If the tube provided with the draw hooks extends through the biasing spring and the latter bears on a flange which is associated with the tube, the clamping mechanism will have a small overall height. But the fact that said clamping mechanisms are spaced from the edge of the board will make it more difficult to actuate the clamping mechanisms by an actuator provided on the stripper. For this reason it will be desirable in such arrangements to provide the actuators for the clamping mechanisms with rams, which are movably mounted in the frame and are operable by suitable drive means in order to open the clamping mechanisms against the force of the biasing spring. The additional mass of such rams will not affect the operation of the needle board because said actuators are associated with the machine frame rather than with the needle beam.

Illustrative embodiments of the invention are shown on the drawing.

DETAILED DESCRIPTION OF THE PREFERRED EMBODIMENTS

Figure 1:
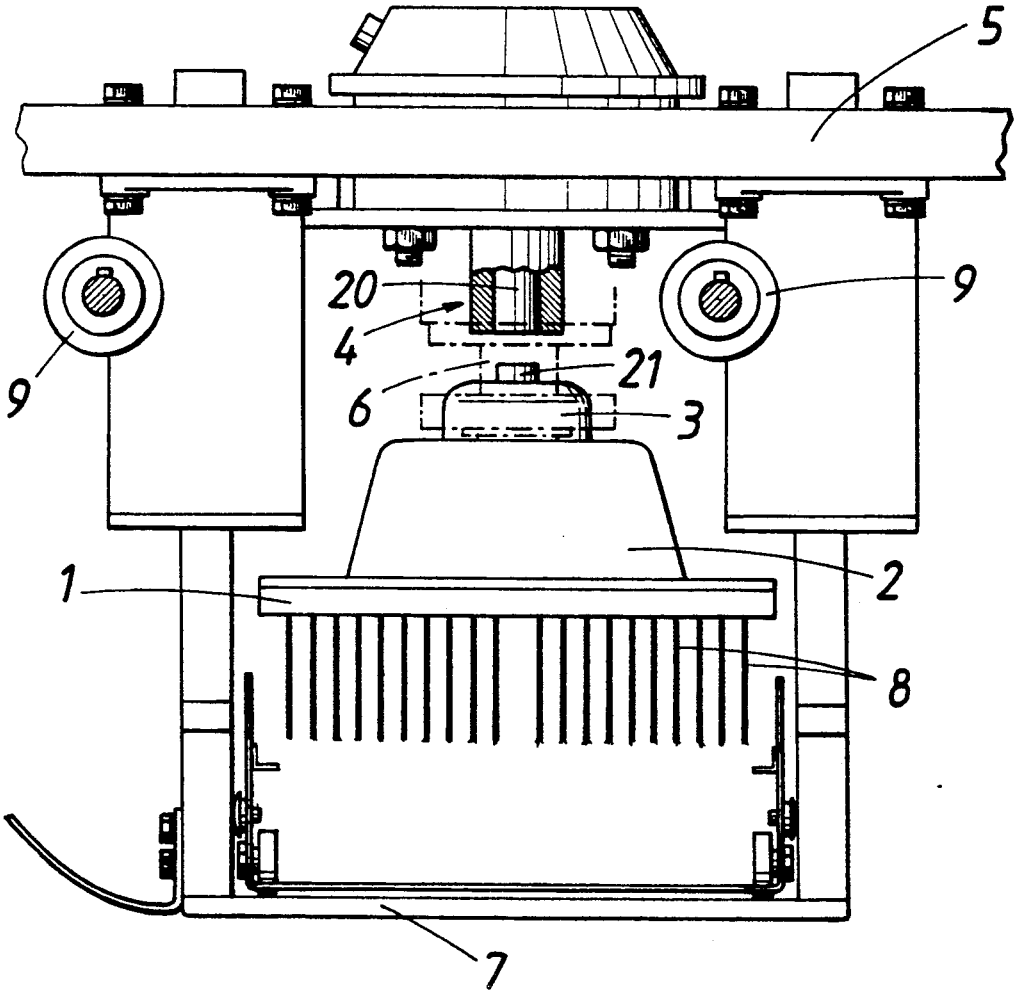
FIG. 1 is a diagrammatic side elevation showing that portion of a needling machine in accordance with the invention which is adjacent to the needle beam.

That portion of the needling machine which is illustrated in FIG. 1 comprises a needle board 1, which is detachably clamped to a needle beam 2 by means of spring-biased clamping mechanisms 3, which can be opened against the spring bias by actuators 4 mounted on the frame 5 of the machine. The needle beam 2 and the needle board 1 clamped thereto can be moved up and down by reciprocable rods 6, which engage the needle beam 2 and are guided in the frame 5 and are driven by an eccentric drive, not shown. The web to be needled extends between a stripper 7 and a backing member, which is not shown, and the needles 8 of the needle board 1 are moved through the stripper 7, which usually consists of a perforate plate, and penetrate the web. The stripper is displaceable in height relative to the frame 5 by adjusting drives 9.

Figure 2:
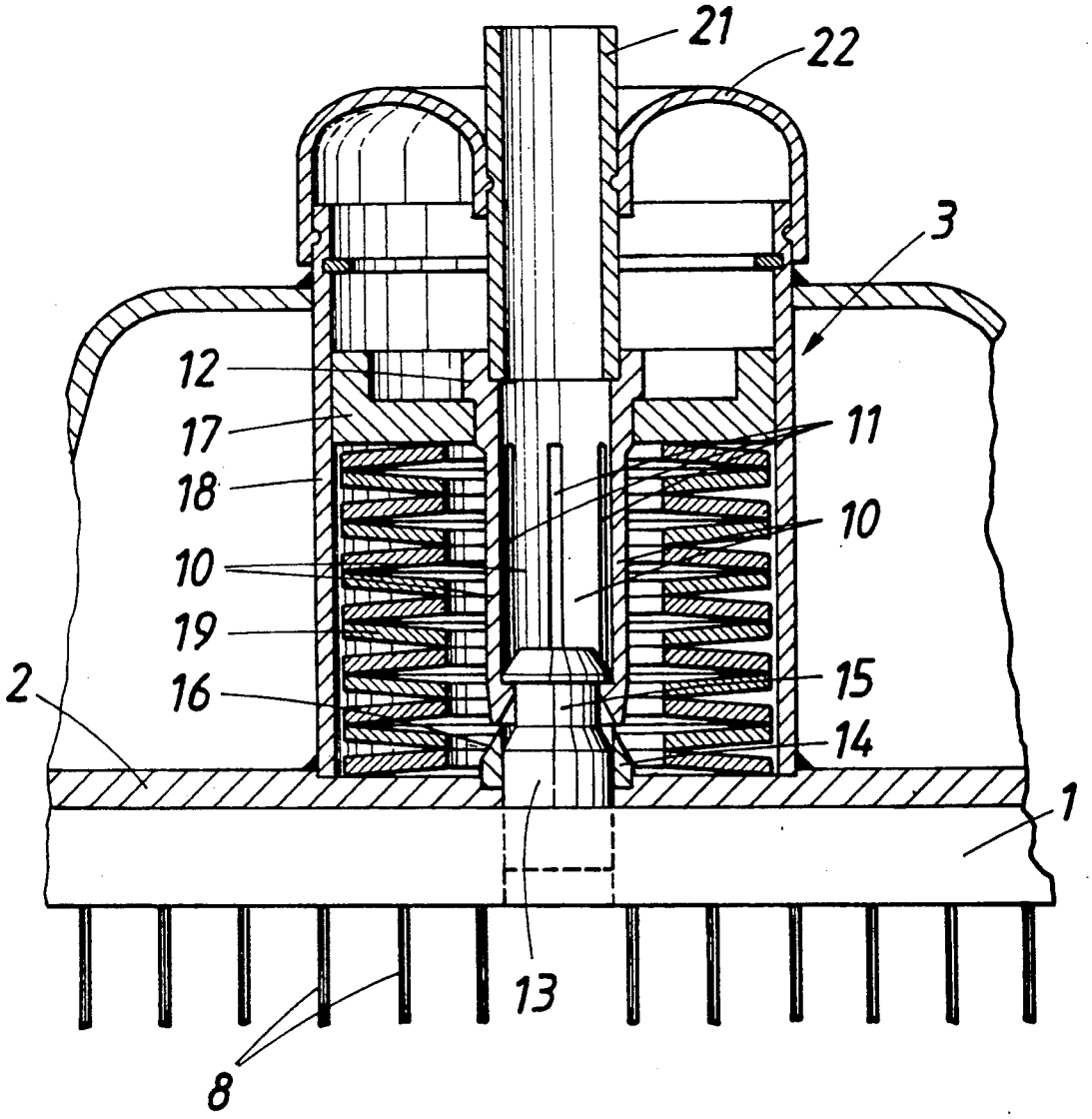
FIG. 2 is an enlarged sectional view showing that portion of the needle beam of that needling machine which is adjacent to one clamping mechanism.

As is apparent from FIG. 2 the spring-biased clamping mechanism 3 of the embodiment shown in FIGS. 1 and 2 comprises a plurality of draw hooks 10, which are constituted by tongues, which are formed in a tube 12 between axial slots 11. The tube 12 receives a tie rod 13, which is connected to the needle board 1 by a tension-resisting joint. That tie rod 13 extends through the needle beam 2 in a guide sleeve 14, by which the needle board 1 is centered. The tie rod 13 has an undercut section 15 for engaging the hooks. Adjacent to that end of the guide sleeve 14 which is directed toward the draw hooks 10 the guide sleeve 14 has an external conical ramp surface 16 that is engageable by the draw hooks 10 so that an axial displacement of the tube 12 relative to the guide sleeve 14 will cause the draw hooks 10 to be deflected from the tie rod 13 as the draw hooks move along the ramp surface 16 and to leave the undercut section 15 of the tie rod 13, which can then freely be pulled out of the guide sleeve 14.

The tube 12 by which the draw hooks 10 are constituted is joined to a flange 17, which is axially slidably guided by a housing cup 18. That housing cup 18 receives a spring 19, which biases the draw hooks 10 and consists of a set of disk springs. The arrangement is such that the biasing spring 19 bears at one end of the needle beam 2 and on the other end on the flange 17 of the tube 12 and biases the draw hooks 10 in the pulling direction. As a result, the draw hooks 10 engaging the tie rod 13 in the undercut section 15 are caused by the biasing spring 19 to automatically clamp the needle board 1 in position to the needle beam 2.

When it is desired to release the needle board 1, the clamping mechanisms which are provided and which in the illustrative embodiment shown in FIGS. 1 and 2 consist of at least two of such mechanisms must be opened by means of the actuators 4. To that end each actuator 4 comprises a ram 20, which is associated with the frame 5 and when the needle beam 2 is at its top dead center can be moved against a pressure-transmitting member 21, which bears on the tube 12, so that the draw hooks 10 can then be displaced against the force of the biasing spring 19 in a sense to open the clamping mechanisms and the draw hooks 10 are resiliently deflected to release the tie rods 13. The annular space between the cup 18 and the pressure-transmitting member 21 is covered by a flexible cuff 22. A needle board 1 is connected to the needle beam 2 by a reverse sequence of operations in that the tie rods 13 are first inserted into the guide sleeves 14 and the ram 20 is retracted so that the biasing spring 19 then pulls the draw hooks 10 to their clamping position shown in FIG. 2.

Figure 3:
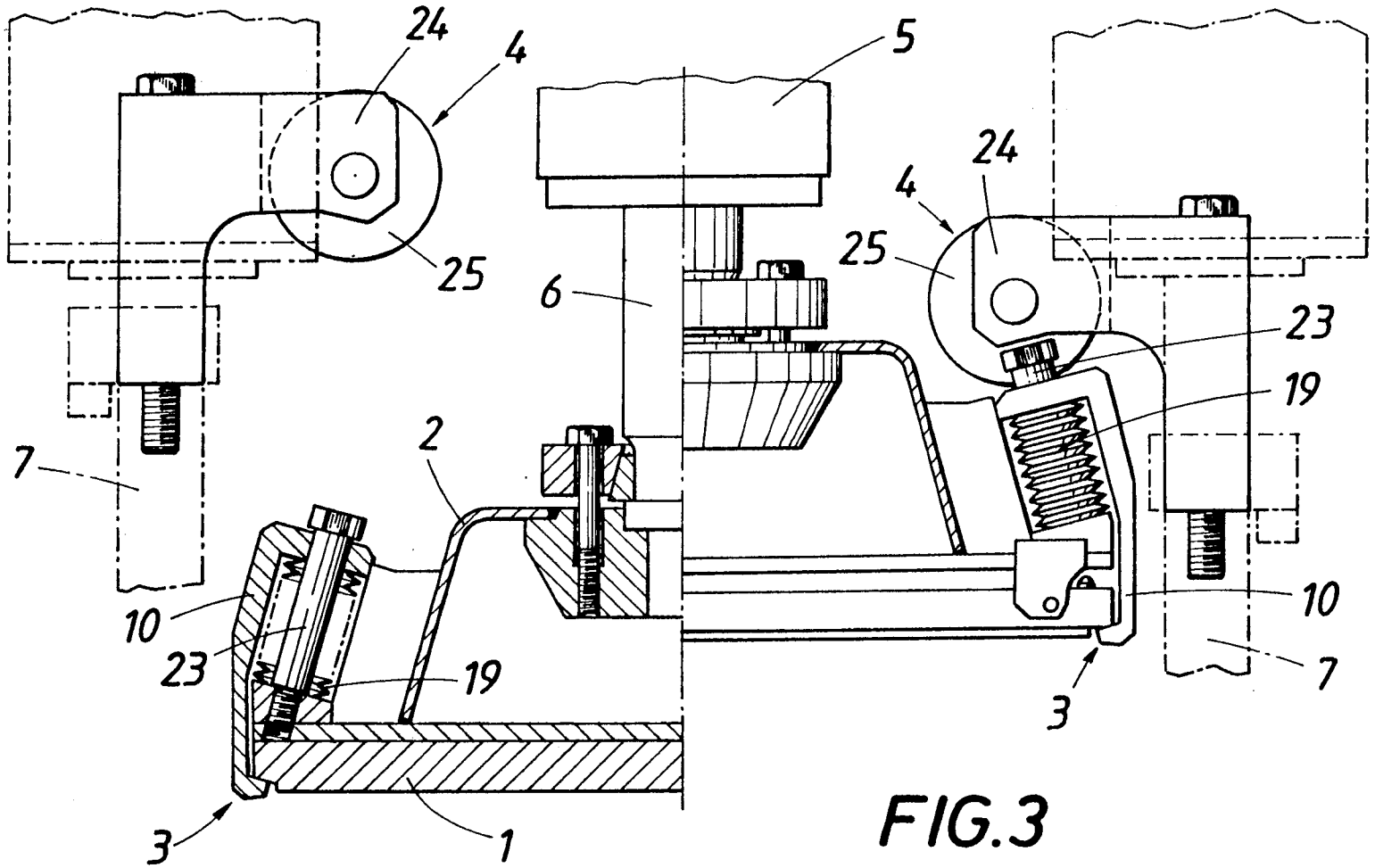
FIG. 3 is a view that is similar to FIG. 2 and shows a needle board with a modified clamping mechanism.

In the illustrative embodiment shown in FIG. 3 the design of the spring-biased clamping mechanisms 3 has been altered but they also comprise draw hooks 10, which in that case embrace the edge portion of the needle board on the outside. On that side of the needle beam which faces away from the needle board 1 each draw hook 10 is slidably mounted on a guide pin 23, which has been screwed into the needle beam 2 and extends through the biasing spring 19. Because the guide pin is inclined toward the needle beam 2 about an axis which is parallel to the edge of the board, a movement of the draw hooks 10 in an opening sense will cause the needle board 1 to be released with a freedom of lateral movement so that the needle board can be pulled out under the needle beam 2 in a direction which is parallel to the edge of the board while the needle board is still supported on the draw hook 10.

In accordance with FIG. 3 the actuators 4 for opening the clamping mechanisms 3 are constituted by coupling stops 24, which are nondisplaceably connected to the stripper 7. When the needle beam 2 is at its top dead center and the stripper 7 is then downwardly adjusted, as is indicated in the right-hand half of FIG. 3, the coupling stop 24 will apply pressure to the draw hooks 10 to displace them in an opening sense against the force of the biasing springs 19 so that the needle board 1 will be released. The coupling stop 24 is provided with a run-up roller 25 in order to avoid sliding friction. When a new needle board 1 has been inserted and the stripper 7 is returned to its initial position, as is shown on the left in FIG. 3, the needle board will automatically be clamped because the draw hooks 10 under the bias of the springs 19 pull the needle board against the needle beam 2.

For this reason a replacement of a needle board can automatically be effected very quickly and without a need for a substantial expenditure of work and this can be accomplished regardless of the design of the clamping mechanisms. Besides, the spring-biased draw hooks permit a simple monitoring of the clamping of the needle board because a draw hook which does not engage the needle board or the tie rod will be displaced beyond its clamping position by the biasing spring and this condition can be detected by a feeler.

I claim:

1. In a needling machine comprising a component consisting of a frame, a needle beam, a plurality of rods longitudinally slidably mounted in said frame and reciprocable to move said needle beam up and down, a needle board, holding means for detachably mounting said needle board on said needle beam, and a component consisting of a stripper adjustably mounted in said frame and adapted to cooperate with said needle board, the improvement wherein said holding means comprises a plurality of clamping mechanisms mounted on said needle beam and engaging said needle board, the clamping mechanisms being movable in an opening sense to release said needle board and comprising biasing spring means urging said needle board against said needle beam, and actuating means mounted on said component and operable to move said clamping mechanisms in said opening sense against the force of said spring means.

2. The improvement set forth in claim 1, wherein said needle board defines a plane and said clamping mechanisms comprise draw hooks, biased by said biasing spring means to pull said needle board transversely to said plane against said needle beam and protruding from the needle beam on a side thereof which is remote from the needle board, the hooks being mounted on said side of the needle beam to be slidable transversely to said plane.

3. The improvement set forth in claim 2, wherein said needle board comprises an outer edge portion and said draw hooks embrace said needle board at said outer edge portion.

4. The improvement set forth in claim 3, wherein said needle beam is provided on the remote side with guides for slidably guiding said draw hooks transversely to said plane and said guides are inclined toward said needle beam about an axis which is parallel to said edge portion of said needle board.

5. The improvement set forth in claim 3, wherein said needle beam is provided on the remote side with guides for slidably guiding said draw hooks transversely to said plane and said guides consist of guide pins extending through said biasing spring means.

6. The improvement set forth in claim 5, wherein said guiding pins are inclined toward said needle beam about an axis which is parallel to said edge portion of said needle board.

7. The improvement set forth in claim 2, wherein each of said clamping mechanisms comprises a tie rod connected to said needle board and extending through said needle beam, the tie rod having an undercut section, said draw hooks engage said tie rods at said undercut section and said needle beam has ramp surfaces for engaging said draw hooks and for deflecting said draw hooks from said undercut section as said draw hooks are displaced by said actuating means in said opening sense.

8. The improvement set forth in claim 7, wherein said clamping mechanisms comprise a plurality of tubes, in which respective ones of said tie rods are slidably mounted and each of said tubes is formed with angularly spaced apart axial slots and with said draw hooks between said slots.

9. The improvement set forth in claim 8, wherein said tubes extend through said biasing spring means and are formed each with a flange engaging said biasing spring means.

10. The improvement set forth in claim 7, wherein a plurality of guide sleeves extend through said needle beam, each of said tie rods is slidably mounted in one of said guide sleeves, and said ramp surfaces are conical.

11. The improvement set forth in claim 1, wherein said actuating means comprise a plurality of coupling stops fixed to said stripper and adapted to cooperate with respective ones of said clamping mechanisms.

12. The improvement set forth in claim 11, wherein each of said coupling stops comprises a roller for engaging the associated clamping mechanism.

13. The improvement set forth in claim 1, wherein said actuating means comprises ram movably mounted in said frame and operable to move said clamping mechanisms in said opening sense.

* * * * *